US009648408B2

(12) United States Patent
Korch-Haahr et al.

(10) Patent No.: US 9,648,408 B2
(45) Date of Patent: May 9, 2017

(54) EAR HOOK WITH WIRE HOOK

(71) Applicant: GN Netcom A/S, Ballerup (DK)

(72) Inventors: Camilla Korch-Haahr, Ballerup (DK); Stig Holbek, Ballerup (DK); Peter Ulrik Kann, Ballerup (DK)

(73) Assignee: GN Netcom A/S (DK)

( * ) Notice: Subject to any disclaimer, the term of this patent is extended or adjusted under 35 U.S.C. 154(b) by 0 days.

(21) Appl. No.: 14/972,752

(22) Filed: Dec. 17, 2015

(65) Prior Publication Data

US 2016/0182994 A1 Jun. 23, 2016

(30) Foreign Application Priority Data

Dec. 17, 2014 (EP) ..... 14198425

(51) Int. Cl.
*H04R 1/10* (2006.01)

(52) U.S. Cl.
CPC ..... *H04R 1/1033* (2013.01); *H04R 1/105* (2013.01); *H04R 1/1058* (2013.01)

(58) Field of Classification Search
CPC ..... H04R 2225/023; H04R 2225/025; H04R 1/105; H04R 2225/021; H04R 2225/63; H04R 2460/13; H04R 1/1016
USPC ..... 381/328, 330, 370, 375, 379, 380–381
See application file for complete search history.

(56) References Cited

U.S. PATENT DOCUMENTS

| | | | | |
|---|---|---|---|---|
| 6,233,344 | B1 | 5/2001 | Clegg et al. | |
| 6,396,935 | B1 * | 5/2002 | Makkonen | H04B 1/385 381/381 |
| 6,950,531 | B2 * | 9/2005 | Rickards | G02C 11/10 381/381 |
| 7,020,300 | B1 | 3/2006 | Villaverde | |
| 8,073,180 | B2 * | 12/2011 | Bruckhoff | H04R 1/105 381/381 |
| 8,111,862 | B2 * | 2/2012 | Wu | H04R 1/083 381/381 |
| 2013/0208939 | A1 | 8/2013 | Kolton | |

FOREIGN PATENT DOCUMENTS

| | | |
|---|---|---|
| CN | 1187101 | 7/1998 |
| WO | WO 96/15646 | 5/1996 |

* cited by examiner

*Primary Examiner* — Suhan Ni
(74) *Attorney, Agent, or Firm* — Altera Law Group, LLC

(57) ABSTRACT

Disclosed is a headset and an ear hook for a headset, the headset comprising a housing portion and a microphone component, the microphone component comprising a microphone boom, the microphone boom comprising a wire, wherein the ear hook comprises:

a first end structurally connected to the housing portion;

a second end comprising a wire holder configured for detachable retention of the wire from the microphone boom; and where a portion of the ear hook between the first end and the second end is configured for attaching the ear hook to an ear of a user.

14 Claims, 6 Drawing Sheets

EAR HOOK WITH WIRE HOOK

FIELD

The present disclosure relates to a headset and an ear hook for a headset, the headset comprising a housing portion and a microphone component, the microphone component comprising a microphone boom, and the ear hook comprises a first end structurally connected to the housing portion.

BACKGROUND

CN1053550 discloses one kind of ear plugs headphones with detachable ear hook, ear plugs its installation in a signal transmission line headphones, ear plugs to assist the speaker headphones holding steady in the ear shell; plug ear headphones that include at least one shaped ear speaker and a speaker connected to the signal transmission line; the earhook having a first end and a second end, comprising: an ear hook type, disposed on the first end, to hang on the ear shell body and fixed; a signal transmission line retaining means disposed on the second end, for fixing a part of the signal transmission line, and the speaker and a signal transmission line retaining means retain a suitable length of the signal transmission line.

US20130208939 discloses an earphone support for an in-ear, earbud-type of headphone which has an earphone with a portion for insertion into a user's ear canal, and a portion for connecting to a cable. An armature connects the earphone to the cable and the armature is associated with a connector for maintaining a portion of the earphone cable in a slack condition when another portion or the earphone cable is drawn taught. It is anticipated that support for the slack portion of the cable may be provided by a separate ear hook apparatus, or by a loop formed of the earphone cable.

SUMMARY

Disclosed is an ear hook for a headset, the headset comprising a housing portion and a microphone component, the microphone component comprising a microphone boom, the microphone boom comprising a wire, wherein the ear hook comprises:

- a first end structurally connected to the housing portion;
- a second end comprising a wire holder, such as a wire hook, configured for detachable retention of the wire from the microphone boom; and where a portion of the ear hook between the first end and the second end is configured for attaching the ear hook to an ear of a user.

In a headset with a wired connection, the wire/audio cable can often get in the way of the user because, but its function, it has to be long. To prevent the uncontrolled movement of the audio cable's movement can be partially arrested by releaseably attaching to or through part of the ear hook. The audio cable then will be loosely and preferably slideably held adjacent the ear hook, preferably routed under or behind the user's head.

It is an advantage of the ear hook that it comprises a wire holder or attachment means, holding means, support structure, or retention means, such as a wire hook, for holding, attaching, or retaining a wire or a cable or a cord, whereby the wire will not disturb, interfere with or be annoying for the user of the headset, for example by hanging in front of the user's face, mouth, eyes, hands etc. When the wire is retained in the wire holder, the wire is not free to move without limitation, and thus the wire can be kept away from the users eyes, mouth etc. Since the wire is held by the wire holder in the second end of the ear hook, the wire can be retained behind or at the ear of the user, which is advantageous for keeping the wire away from the face of the user of the headset.

The wire holder may be shaped as a hook, as an anchor, as a short tube, as a groove or channel etc, i.e. any shape suitable for detachable retention of a wire. The wire holder is configured such that it is easy for the user to attach the wire in the wire holder and to remove or detach the wire from the wire holder again. Preferably, it is possible for any user to attach and detach the wire in the wire holder by using one hand.

The wire holder is configured for retaining, such as attaching, fastening or fixing the wire. Further, the wire hook may tighten or clamping the wire, such that the wire is kept still and steady in wire holder and unmovable. Hereby the wire does not slide in the wire holder, but is kept in one position.

The wire holder may be configured to support or guide the wire in the wire holder, whereby the wire is movable in the wire holder, such as able to slide, shift sideways, up/down etc.

The headset is configured to be used for transmission of audio. The wire may be used for wired transmission of audio signals to/from the headset, and/or used for providing electrical power to the headset, and/or used for charging a battery of the headset etc.

The housing portion or main body or speaker-tower of the headset may comprise a processing unit, and/or a transceiver connected to the processing unit and being configured for outputting a transceiver output signal representative of an audio signal to form a input signal to the processing unit, and/or an earphone comprising a speaker configured for transmission of an audio to the user of the headset, and/or a battery. The housing portion and/or the earphone in the housing portion may have a size which fits in the concha of the user's ear. Alternatively, the housing portion may have size which fits on the whole auricle of the user.

The headset may comprise a headband, and/or a neckband, and/or one or more earphones, where the one or more earphones may be structurally implemented in the housing portion or speaker-tower or be separate of the housing portion.

The housing portion may be circular cylindrical, as the battery is typically circular or round, so the housing portion may be constructed to fit around the battery, while keeping the housing portion as little as possible.

A portion of the ear hook between the first end and the second end of the ear hook is configured for attaching the ear hook to an ear of a user. Thus the ear hook is shaped to fit around an ear, i.e. around the pinna of the outer ear, i.e. to hang on the pinna.

The headset comprises a microphone component, the microphone component comprising a microphone boom, the microphone boom comprising a wire. The microphone component may comprise a part or component which is connected with or attached to the housing portion. The microphone boom may comprise one or more microphones or holes for providing for example a directional microphone, which may be suitable for a microphone for a headset. The microphone boom comprises a wire, for example the wire may extend from the microphone boom.

The wire holder may be configured for detachable retention of a wire from a microphone boom of the headset.

In some embodiments the wire holder is circular, such as substantially circular. The wire holder may be circular to match or fit the wire, which is typically circular. The wire holder may be circular on its inside surface and/or on its outside surface.

In some embodiments the inner or internal diameter of the wire holder is configured to match, correspond to, fit, be similar or identical or just smaller that the outer or external diameter of the wire. Hereby the wire holder provides a tight fit with the wire, thereby obtaining a steady retention of the wire, avoiding that the wire slides in the wire holder.

In some embodiments the wire holder is made of a resilient or spring material. For example the wire holder may be made of a more resilient material than the wire, such that wire holder can be bent or twisted for example when the wire is attached in and detached from the wire holder.

In some embodiments the wire holder is made from a flexible material with or without position memory, configured to be bent at least partly around the wire. The material may be flexible, bendable, ductile, pliable etc. When the wire holder is bent around the wire, the wire may be kept even more firmly in the wire holder, thereby avoiding that the wire slides in the wire holder.

In some embodiments a gap is configured between an end of the wire holder and a stem of the wire holder, where the gap is smaller, such as slightly smaller, than the diameter of the wire. Hereby the wire can be pushed by the users hand or fingers through the gap into the wire holder and be retained in the wire holder due to that the gap is smaller than the diameter of the wire, thus the wire cannot escape the wire holder on its own, the user must push the wire in and out of the wire holder.

In some embodiments the first end of the ear hook is structurally connected to the housing portion by that or by means of or via or through that the ear hook is structurally connected to a first component configured to be arranged or positioned to at least partly enclose or encase or surround or encircle at least a part of the housing portion of the headset, such as at least a part of the circumference of the housing portion, in case the housing portion is circular, such as circular cylindrical.

Thus the first component may be arranged to at least partly enclose or encase or surround at least a part of the housing portion. The first component may fully enclose the housing portion if for example the first component is a closed component such as a full piece of component. The first component may partly enclose the housing portion if fx the first component is an open or half component which does not fully encase the housing portion.

In some embodiments the first component is configured to entirely or wholly or substantially or fully enclose the circumference of the housing portion. Thus the first component may be a closed component completely encircling the housing portion. When the housing portion is for example circular cylindrical the first component may enclose the circumference of the housing portion. If the housing portion is not circular cylindrical or the like, the first component may be configured to enclose the linear distance around the edge of the housing portion in or about one axis, for example the x axis. If the first component is of a spring material, it needs to surround the housing at least 50% of the circumference to prevent it from popping off.

In some embodiments the first component is configured to partly enclose the circumference of the housing portion i.e. a part of the first component does not enclose the housing portion. The first component may be termed an "open component" in this example, as the first component is not closed all the way around the circumference of the housing portion.

In some embodiments the first component is configured to be arranged to at least partly enclose a major part of the housing portion, such as a major part of the circumference of the housing portion, when the housing portion is for example circular cylindrical. This may apply both when the first component entirely encloses and when the first component only partly encloses the housing portion, such as the circumference of the housing portion. If a major part, such as a majority, a main part, the most of, or a greater part of the housing portion is at least partly enclosed by the first component, the first component will have a better fit and stability on the housing portion. A major part may be such as more than 50%, 60%, 70%, 80%, or 90% of the area or the area of the circumference of the housing portion. The full circumference of the housing portion is 360 degrees when the housing portion is circular cylindrical, so the first component may cover more than 180 degrees, more than 200 degrees, more than 250 degrees, more than 300 degrees, more than 350 degrees of the circumference of the housing portion.

In some embodiments the first component is configured to be arranged to at least partly enclose a minor part of the housing portion, such as a minor part of the circumference of the housing portion. A minor part may be a minority, or a smaller part of the housing portion. A minor part may be such as less than 50%, 40%, 30%, 20%, 10% of the area of the housing portion or the area of the circumference of the housing portion. The full circumference of the housing portion is 360 degrees when the housing portion is circular cylindrical, so the first component may cover less than 180 degrees, less than 160 degrees, less than 100 degrees, less than 50 degrees of the circumference of the housing portion.

In some embodiments the first component is movable or turnable or rotatable relative to the housing portion. Thus if the housing portion is circular cylindrical, the first component may be rotatable relative to the housing portion. Alternatively, if the housing portion is squared or rectangular cylindrical, the first component may be turnable relative to the housing portion, such as configured to be arranged in four different positions, one position for each plane or face of the square or rectangular cylinder. As the ear hook is connected with the first component, the ear hook is also movable or turnable or rotatable relative to the housing portion.

In some embodiments the first end of the ear hook extends radially from the first component or the orientation of the ear hook is normal to the first component or the ear hook points out of the first component or away from the first component. Thus at the point or area where the ear hook is structurally connected to the first component, the ear hook extends radially from the first component and thus extends radially from the housing portion which the first component is arranged on or relative to. Alternatively, the ear hook may extend tangentially from the first component or the orientation of the ear hook is tangentially to the first component.

The present invention relates to different aspects including the ear hook described above and in the following, and corresponding methods, devices, systems, kits, uses and/or product means, each yielding one or more of the benefits and advantages described in connection with the first mentioned aspect, and each having one or more embodiments corresponding to the embodiments described in connection with the first mentioned aspect and/or disclosed in the appended claims.

According to an aspect, disclosed is a headset comprising an ear hook, a housing portion and a microphone component, the microphone component comprising a microphone boom, the microphone boom comprising a wire, wherein the ear hook comprises:

a first end structurally connected to the housing portion;

a second end comprising a wire holder, such as a wire hook, configured for detachable retention of the wire from the microphone boom; and where a portion of the ear hook between the first end and the second end is configured for attaching the ear hook to an ear of a user.

In some embodiments the microphone component comprises a second component connected to the microphone boom, the second component is configured to attach the microphone component to the housing portion, where the second component is movable or turnable or rotatable relative to, for example the circumference of, the housing portion. Thus the microphone boom is also movable relative to the housing portion as the microphone boom is connected with the second component.

The second component is configured to be arranged or positioned to at least partly enclose or encase or surround at least a part of, for example the circumference of, the housing portion of the headset.

The second component may fully enclose the housing portion if fx the second component is a closed component such as a full piece of component. The second component may partly enclose the housing portion if fx the second component is an open or half component which does not fully encase the housing portion.

In some embodiments the second component is configured to entirely or wholly or substantially or fully enclose the circumference of the housing portion. Thus the second component may be a closed component completely encircling the housing portion. When the housing portion is for example circular cylindrical the second component may enclose the circumference of the housing portion. If the housing portion is not circular cylindrical or the like, the second component may be configured to enclose the linear distance around the edge of the housing portion in or about one axis, for example the x axis.

In some embodiments the second component is configured to partly enclose the circumference of the housing portion i.e. a part of the second component does not enclose the housing portion. The second component may be termed an "open component" in this example, as the second component is not closed all the way around the circumference of the housing portion.

In some embodiments the second component is configured to be arranged to at least partly enclose a major part of the housing portion, such as a major part of the circumference of the housing portion, when the housing portion is for example circular cylindrical. This may apply both when the second component entirely encloses and when the second component only partly encloses the housing portion, such as the circumference of the housing portion. If a major part, such as a majority, a main part, the most of, or a greater part of the housing portion is at least partly enclosed by the second component, the second component will have a better fit and stability on the housing portion. A major part may be such as more than 50%, 60%, 70%, 80%, or 90% of the area or the area of the circumference of the housing portion. The full circumference of the housing portion is 360 degrees when the housing portion is circular cylindrical, so the second component may cover more than 180 degrees, more than 200 degrees, more than 250 degrees, more than 300 degrees, more than 350 degrees of the circumference of the housing portion.

In some embodiments the second component is configured to be arranged to at least partly enclose a minor part of the housing portion, such as a minor part of the circumference of the housing portion. A minor part may be a minority, or a smaller part of the housing portion. A minor part may be such as less than 50%, 40%, 30%, 20%, 10% of the area of the housing portion or the area of the circumference of the housing portion. The full circumference of the housing portion is 360 degrees when the housing portion is circular cylindrical, so the second component may cover less than 180 degrees, less than 160 degrees, less than 100 degrees, less than 50 degrees of the circumference of the housing portion.

In some embodiments the microphone boom extends radially from the second component or the orientation of the microphone boom is normal to the second component or the microphone boom points out of the second component or away from the second component. Thus at the point or area where the microphone boom is structurally connected to the second component, the microphone boom extends radially from the second component and thus extends radially from the housing portion which the second component is arranged on or relative to. Alternatively, the microphone boom may extend tangentially from the second component or the orientation of the microphone boom is tangentially to the second component.

In some embodiments the microphone boom is oblong and comprises a first end and second end, where the first end is connected to the second component, and where the wire extends from the second end. Thus the wire extends radially from the housing portion via the microphone boom, when the microphone boom extends radially from the housing portion. Thus the wire extends out of the longitudinal axes of the microphone boom.

In some embodiments the microphone boom is oblong and comprises a first end and second end, where the first end is connected to the second component, and where the wire extends from a point between the first end and the second end. Thus the wire may extend sideways from microphone boom and thus for example tangentially with the housing portion. Thus the wire may extend transversal to the longitudinal axes of the microphone boom.

In some embodiments the headset comprises two earphones, and the headset is configured for transmission between the two earphones. Transmission may be transmission of data or audio etc.

In some embodiments a first earphone of the two earphones is comprised in the housing portion of the headset. A second earphone or the two earphones may be comprised in another housing portion, such as second housing portion, of the headset.

In some embodiments the wire is configured to be connected, i.e. wired, with the second earphone of the two earphones, where the second earphone is configured to be arranged at the other or second ear of the user. Thus the other or second housing portion is configured to be arranged at the other or second ear of the user. The ear or the first ear of the user is the ear where the housing portion or first housing portion, microphone boom, wire etc. is at.

In some embodiments the wire is configured to be connected with a charging device for charging the headset and/or the wire is configured to be connected with a software update device for updating the software of the headset.

In some embodiments the wire is configured to be connected with a functional device for connecting a number of wires. Thus the wire from the microphone boom may be connected in the functional device and/or another wire or a second wire from the second earphone or second housing portion may be connected in the functional device. Thus two or more wires may be connected or gathered in the functional device. The functional device may be a charging device for charging the headset, and/or a software update device for updating the software of the headset, and/or a smart phone and/or a tablet or computer.

The functional device may be a device for gathering the wires from the headset, where the functional device can be connected with another device, for example a charging device for charging the headset, and/or a software update device for updating the software of the headset, and/or a smart phone and/or a tablet or computer. The smart phone, tablet or computer may transmit music or other audio to the headset.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
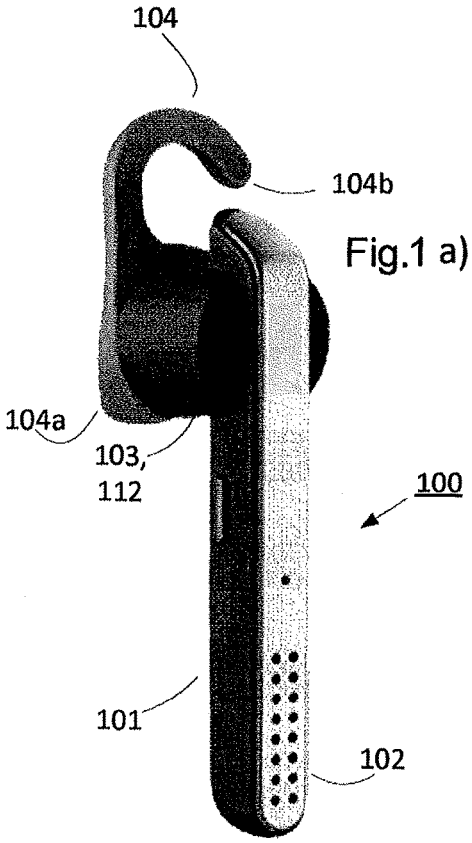
Fig.1 a) PRIOR ART
FIGS. 1*a*, 1*b* and 1*c* schematically illustrate examples of prior art headsets.
Figure 1:
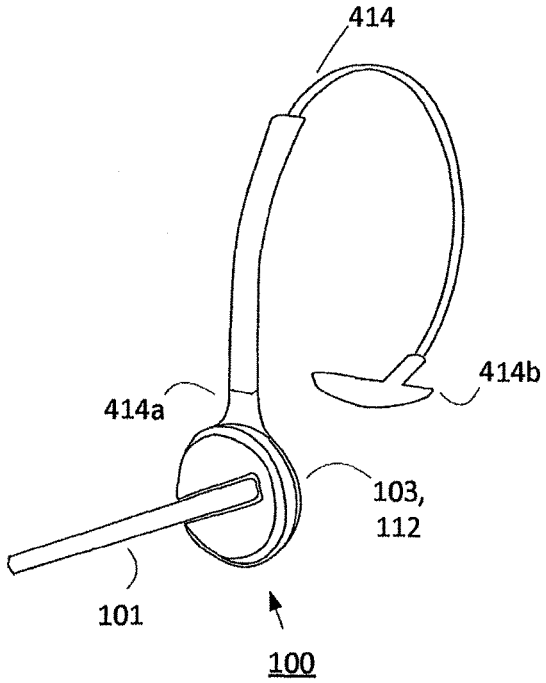
PRIOR ART Fig.1 b)

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

FIG. 1 schematically illustrates examples of prior art headsets.

FIG. 1*a* illustrates an example of a headset 100 comprising a housing portion 103, and a microphone boom 101 attached to the housing portion 103. The housing portion 103 comprises an earphone 112. The microphone boom 101 comprising one or more microphones 102 and/or holes 102 for providing a directional microphone. An ear hook 104 is attached to the housing portion in a first end of the ear hook 104*a*, and a second end 104*b* of the ear hook 104 is shaped as a hook for attaching the headset 100 to an ear of a user.

FIG. 1*b* schematically illustrates an example of a headset 100 comprising a housing portion 103, and a microphone boom 101 attached to the housing portion 103. The housing portion 103 comprises an earphone 112. The microphone boom 101 may comprise one or more microphones and/or holes for providing a directional microphone. A headband 414 is attached to the housing portion in a first end of the headband 414*a*, and a second end 414*b* of the headband 414*b* is configured for attaching the headset 100 to the head of a user.

Figure 1C:
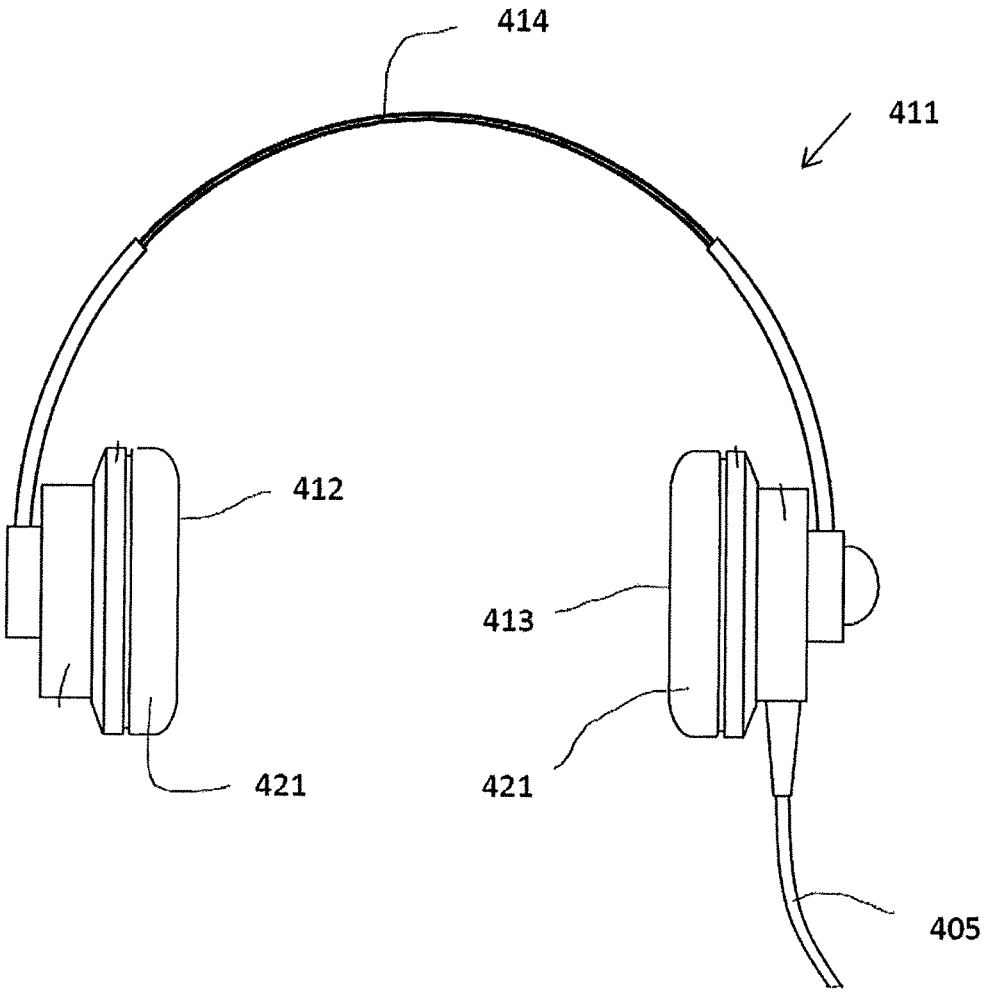
PRIOR ART Fig. 1c)

FIG. 1*c* schematically illustrates an example of a headset 411 comprising two housing portions 403, where each housing portion 403 comprises an earphone 412, 413. The housing portions 403 are connected by a headband 414. A removable cable 405 is attached in the earphone 413. Each of the earphones 412, 413 comprises ear cushions 421.

Figure 2:
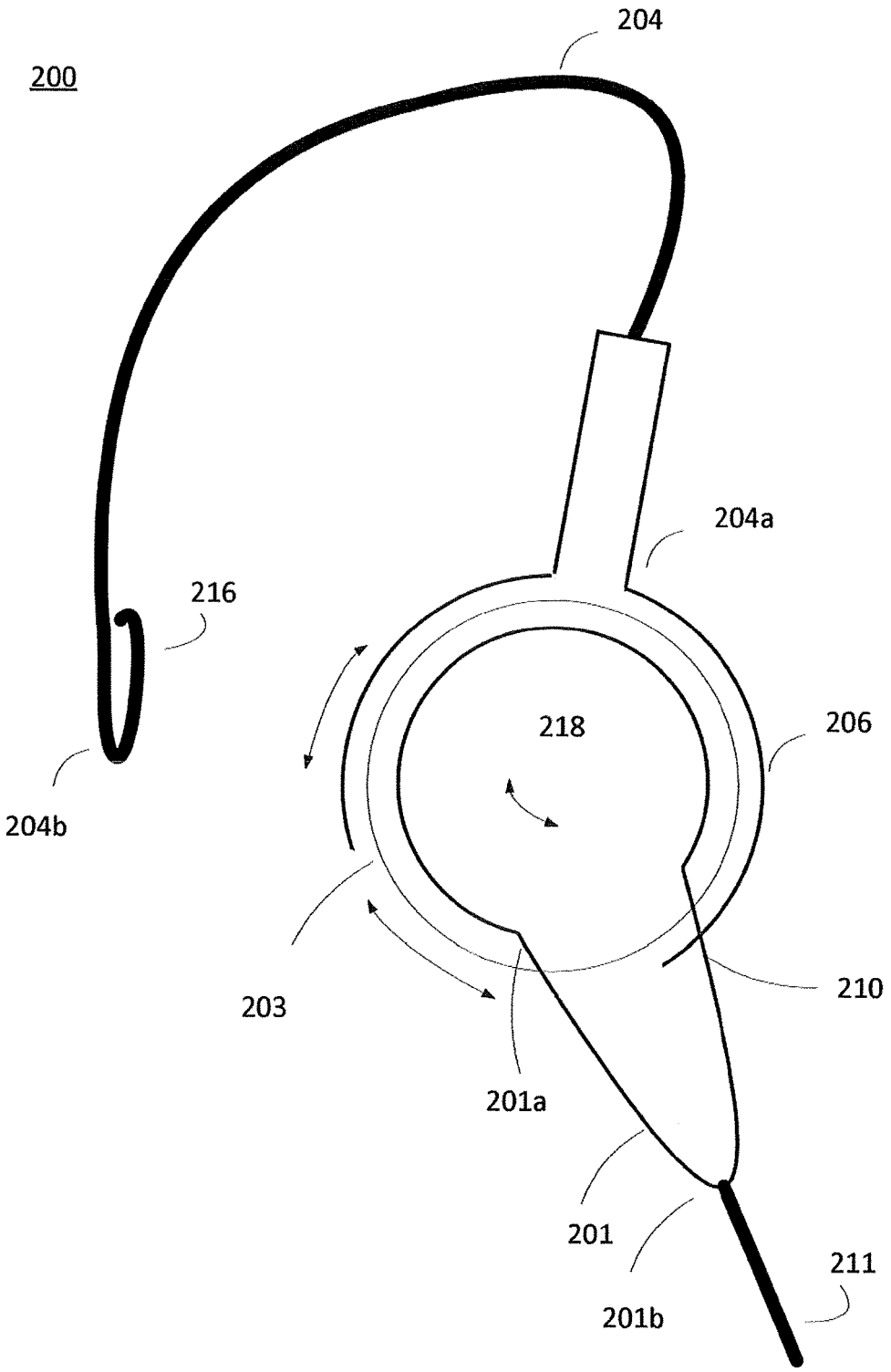
FIG. 2 schematically shows an example of an ear hook for a headset.

FIG. 2 schematically shows an example of an ear hook for a headset.

The headset 200 comprises a housing portion 203 and a microphone component 210, the microphone component 210 comprising a microphone boom 201, the microphone boom 201 comprising a wire 211. The headset comprises an ear hook 204, wherein the ear hook 204 comprises:

- a first end 204*a* structurally connected to the housing portion 203;
- a second end 204*b* comprising a wire holder 216 configured for detachable retention of the wire 211 from the microphone boom 201; and where a portion of the ear hook 204 between the first end 204*a* and the second end 204*b* is configured for attaching the ear hook 204 to an ear of a user. In use, audio cable/wire 211 would be looped back through loop 204*b* thus constraining the movement of the audio cable in the region of the user.

FIG. 2 shows an example where the first end 204*a* of the ear hook 204 is structurally connected to the housing portion by that or by means of or via or through that the ear hook 204 is structurally connected to a first component 206. In the example, the first component 206 is arranged to at least partly enclose at least a part of the housing portion 203 of the headset 200.

FIG. 2 shows an example where the first component 206, which the ear hook 204 is connected to at its first end 204*a*, is movable or turnable or rotatable relative to the housing portion 203, as indicated by the rotation arrows.

FIG. 2 shows an example where the first end 204*a* of the ear hook 204 extends radially from the first component 206.

FIG. 2 shows details of the microphone component 210. The microphone component 210 comprises a second component 218 connected to the microphone boom 201. The second component 218 attaches the microphone component 210 to the housing portion 203. The second component 218 is movable or turnable or rotatable relative to the housing portion 203, as indicated by the rotation arrows.

FIG. 2 shows an example where the microphone boom 201 extends radially from the second component 218.

FIG. 2 also shows an example the microphone boom is oblong and comprises a first end 201*a* and second end 201*b*, where the first end 201*a* is connected to the second component 218, and where the wire 211 extends from the second end 201*b*.

Alternatively, the microphone boom 201 may be oblong and may comprises a first end 201*a* and second end 201*b*, where the first end 201*a* is connected to the second component 218, and where the wire 211 extends from a point between the first end 201*a* and the second end 201*b*, such as halfway (not shown) along the longitudinal axis of the microphone boom 201.

FIG. 3 shows examples of a wire holder of the ear hook.

Figure 3A:
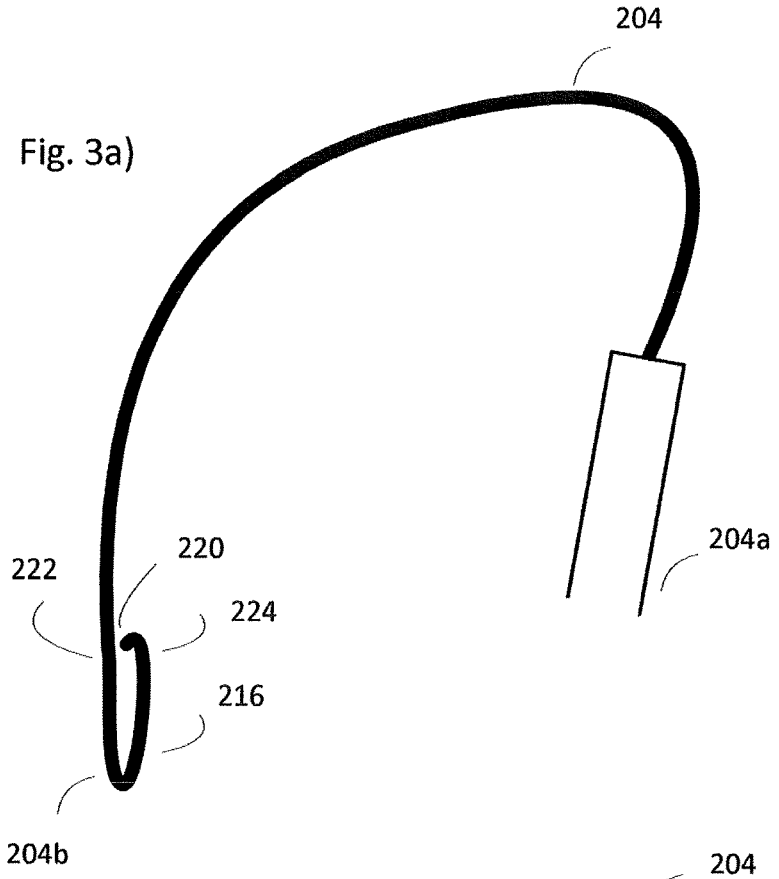
FIGS. 3*a*, 3*b*, 3*c* and 3*d* show examples of a wire holder of the ear hook.

FIG. 3*a* shows an example where the wire holder 216 is oval.

Figure 3B:
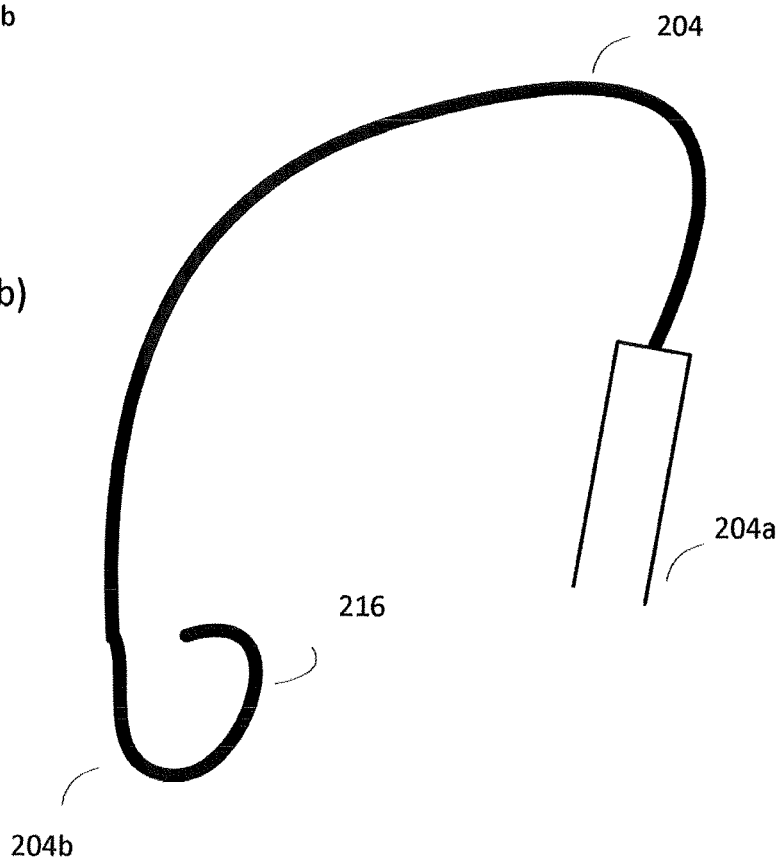

FIG. 3*b* shows an example where the wire holder 216 is substantially circular. An oval or circular wire holder may be configured to retain any wire, such as an oval wire, a circular wire, a wire having a circular or oval circumference, a squared wire or a rectangular wire, a wire having a square or rectangular circumference/profile etc.

Figure 3C:
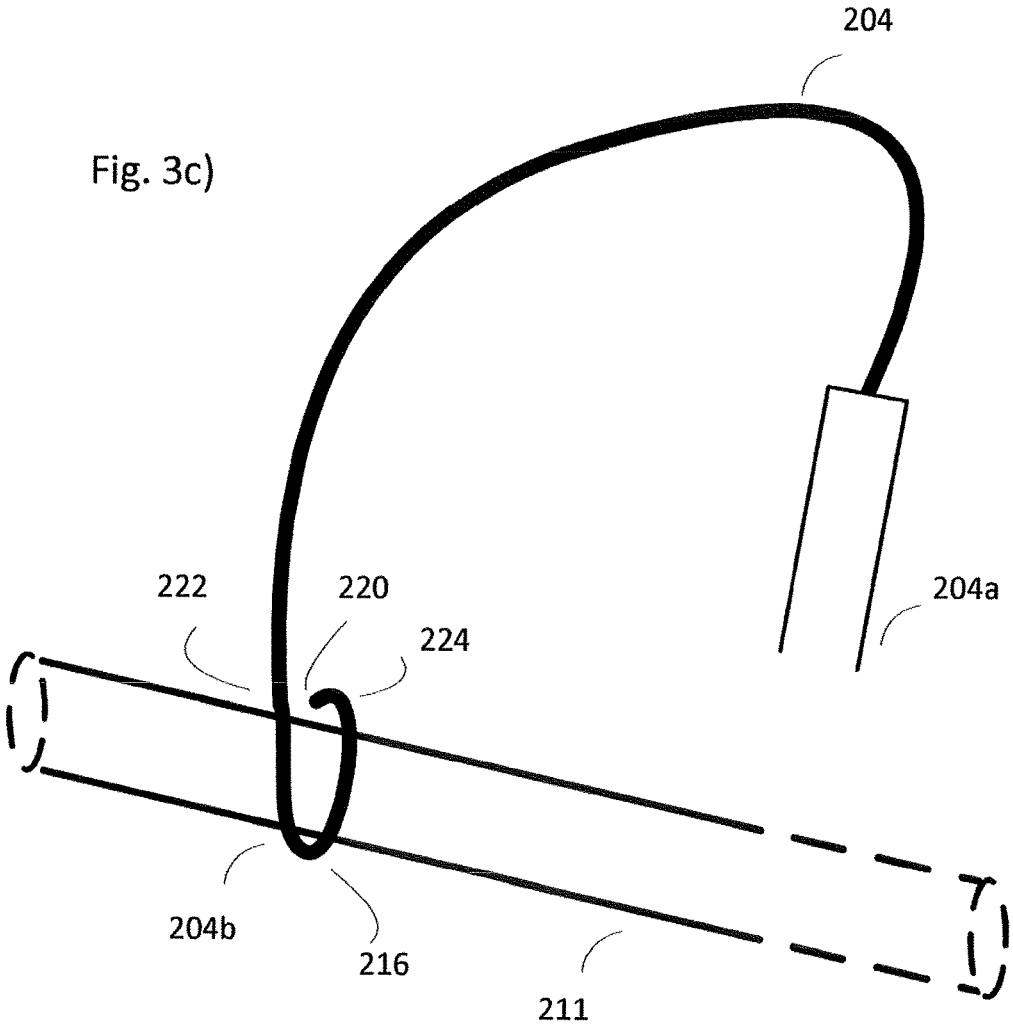

FIG. 3*c* shows an example where the inner or internal diameter of the wire holder 216 matches, or corresponds to or is similar to, such as substantially similar to, the outer or external diameter of the wire 211. FIG. 3*c* also shows an example of a gap 220 which is provided between an end 224 of the wire holder 216 and a stem 222 of the wire holder 216, where the gap 220 is smaller, such as slightly smaller, than the diameter of the wire 211, so that the cable/wire can be forced through the gap by compression of the wire/deflection of the holder or both, and then retain the wire.

Figure 3D:
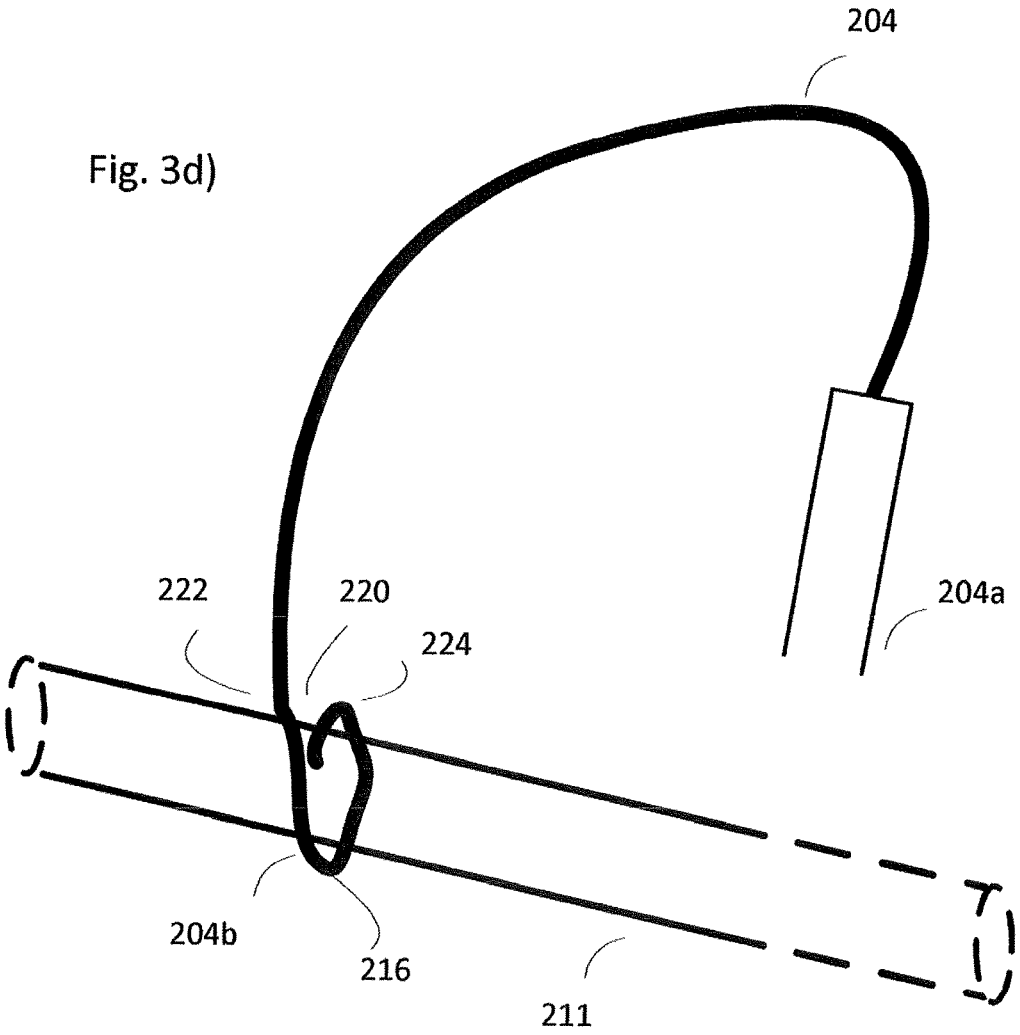

FIG. 3*d* shows an example where the wire holder 216 is bent partly around the wire 211. The wire holder 216 may be made from a flexible material, such that it can be bent around the wire 211. It can also be made of memory wire/material which retains its position when bent.

The wire holders 216 shown in the FIG. 3 may be made of a resilient material.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

100, 200, 411 headset
101, 201 microphone boom
201*a* first end of microphone boom
201*b* second end of microphone boom
102 microphones or holes
103, 203, 403 housing portion
104, 204 ear hook
104*a*, 204*a* first end of ear hook
104*b*, 204*b* second end of ear hook
206 first component
210 microphone component
211 wire
112, 412 earphone
412, 413 ear cushions
414 headband
216 wire holder
218 second component
220 gap in wire holder
222 stem of wire holder
224 end of wire holder

The invention claimed is:

1. An ear hook with wire retention feature, for a headset, the headset comprising a housing portion and a microphone component, the microphone component having a microphone boom, the microphone boom including a wire for delivering signals to said headset, wherein the ear hook comprises:

a first end structurally connected to the housing portion;

flexible portion extending from said first end and configurable to engage at least part of a users's ear to retain the headset on the user;

a flexible second portion having a second end, said second portion extending from said first portion and being bendable into a wire holder at said second end, said wire holder being sizeable to receive said wire therethrough, so that said wire can be directed through said wire holder, back to said earhook and away from the user's face thereby avoiding interference with a user's face.

2. The ear hook according to claim 1, wherein the wire holder is circular.

3. The ear hook according to claim 1, wherein the inner diameter of the wire holder is configured to match the outer diameter of the wire.

4. The ear hook according to claim 1, wherein the wire holder is made of a resilient material.

5. The ear hook according to claim 1, wherein the wire holder is made from a flexible material configured to be bended at least partly around the wire.

6. The ear hook according to claim 1, wherein a gap is configured between an end of the wire holder and a stem of the wire holder, where the gap is slightly smaller than the diameter of the wire.

7. The ear hook according to claim 1, wherein the first end of the ear hook is structurally connected to the housing portion by that the ear hook is structurally connected to a first component configured to be arranged to at least partly enclose at least a part of the housing portion of the headset.

8. The ear hook according to claim 1, wherein the first component is movable relative to the housing portion.

9. The ear hook according to claim 1, wherein the first end of the ear hook extends radially from the first component.

10. A headset comprising an ear hook with wire retaining feature, a housing portion and a microphone component, the microphone component having a microphone boom, the microphone boom including a wire, wherein the ear hook comprises:

a first end structurally connected to the housing portion;

a second end comprising a wire holder, configured for detachable retention of the wire from the microphone boom; and where a portion of the ear hook between the first end and the second end is bendable into a shape to surround at least part of a user's ear so that said wire can be directed through said wire holder, back to said earhook and away from the user's face thereby avoiding interference with a user's face.

11. The headset according to claim 10, wherein the microphone component comprises a second component connected to the microphone boom, the second component is configured to attach the microphone component to the housing portion, where the second component is movable relative to the housing portion.

12. The headset according to claim 10, wherein the microphone boom extends radially from the second component.

13. The headset according to claim 10, wherein the microphone boom is oblong and comprises a first end and second end, where the first end is connected to the second component, and where the wire extends from the second end.

14. The headset according to claim 10, wherein the microphone boom is oblong and comprises a first end and second end, where the first end is connected to the second component, and where the wire extends from a point between the first end and the second end.

* * * * *